US006964285B1

(12) United States Patent
Battaglia

(10) Patent No.: US 6,964,285 B1
(45) Date of Patent: Nov. 15, 2005

(54) APPARATUS FOR FILLING FOOD TRAYS AT HIGH SPEEDS

(76) Inventor: John Battaglia, 78 McKinley St., Hackensack, NJ (US) 07601

( * ) Notice: Subject to any disclaimer, the term of this patent is extended or adjusted under 35 U.S.C. 154(b) by 0 days.

(21) Appl. No.: 10/642,369

(22) Filed: Aug. 15, 2003

Related U.S. Application Data

(63) Continuation-in-part of application No. 10/064,308, filed on Jul. 1, 2002, now Pat. No. 6,715,519.

(51) Int. Cl.[7] ..... B65B 1/04
(52) U.S. Cl. ..... 141/129; 141/160; 141/153
(58) Field of Search ..... 141/1, 129–140, 141/153, 155–158, 160, 183, 188

(56) References Cited

U.S. PATENT DOCUMENTS 6,715,519 B1 * 4/2004 Battaglia ..... 141/160

* cited by examiner

*Primary Examiner*—Steven O. Douglas
(74) *Attorney, Agent, or Firm*—Richard A Joel, Esq.

(57) ABSTRACT

A compact high speed food depositor comprises a pump driven by a first servomotor to feed food product through a multi-tube outlet to a stationary housing. A second servomotor drives a rocking cut-off valve within the housing to feed food product through three apertures in the housing. A computer with a touch screen controls the servomotors and calculates the required weight deposit along with the speed and placement of food product in the moving trays.

9 Claims, 3 Drawing Sheets

APPARATUS FOR FILLING FOOD TRAYS AT HIGH SPEEDS

CROSS REFERENCE TO RELATED APPLICATIONS

This application is a continuation-in-part of Ser. No. 10/064,308 filed Jul. 1, 2002 now U.S. Pat. No. 6,715,519.

BACKGROUND OF INVENTION

The present invention relates to a computer-controlled apparatus and method for depositing foods/sauces into plastic trays that are moving at high speed using servomotors coupled to a computer. A pump with a three column output is driven by a first servomotor to provide a food deposit which is fed through three tubes to a cut-off nozzle housing. A second servomotor drives a rocking cut-off valve within the stationary cut-off housing to deposit a predetermined measure in a moving tray.

To fill trays with food or sauces, a typical apparatus of the prior art generally requires three reciprocating cylinders to pump the food product to respective outlets and a carousel to move the three filling outlets over the trays at the same speed as the trays in order to fill the trays without leaking or spilling over the edges.

The prior art apparatus is large in size, requires complicated pneumatic control systems and complicated mechanical parts in order to operate. There is considerable maintenance involved with this equipment (down time), there are many parts to clean at the end of each production run and making weight deposit adjustments requires tools to set mechanical stops. Accuracy across all three cylinders tends to vary due to unique wear on each of the cylinders. This means that there is always the possibility of weight variation in each tray. Because the three cylinders are driven from one common source, adjusting weights is complicated. All of these issues combined add up to long setup times, usually requiring qualified maintenance personnel.

In the prior art, U.S. Pat. No. 5,906,297 to Cole discloses a multi outlet depositor that displaces first and second portions of material and includes first and second positive displacement vane pumps. The pumps are coupled together so that the volume of the first portion varies according to the volume of the second portion.

The state of the prior art is also shown in patents such as U.S. Pat. No. 6,212,861 to Tsuruta on a Forming, Filling and Sealing Machine for Standing Pouch and U.S. Pat. No. 6,058,680 to Meile, et al on a Method and Apparatus for Forming and Hermetically Sealing Slices of Food Items. Also of interest are U.S. Pat. Nos. 5,155,969 to Kue and 4,997,664 to Williams. The prior art fails to disclose an apparatus of the type disclosed herein which uses a single positive displacement gear pump driven by a servomotor, controlled by a computer via a user-friendly touch screen to feed food product to a plurality of tubes over the trays. The apparatus includes a rocking plastic cut-off nozzle that is driven by a second servomotor. The nozzle is coupled to a stationary housing.

Applicant's application, Ser. No. 10/064,308, filed Jul. 1, 2002 now U.S. Pat. No. 6,715,519 discloses a positive displacement gear pump driven by a first servomotor and a cut-off nozzle driven by a second servomotor. The pump feeds product to a horizontal tube which cooperates with a rotating cut-off nozzle to deliver product to a series of fast moving trays. While the design works well with certain fillings, applicant is concerned with fillings that are smooth and uniform and fillings that have chunks blended with water juices.

SUMMARY OF INVENTION

The invention relates to an apparatus for filling food trays with foods or sauces as the trays move along a conveyor at high speeds of approximately 150 trays per minute. The apparatus is particularly suited to dispensing fillings that are smooth and uniform and fillings that have chunks blended with watery juices.

The apparatus comprises a compact integral unit including a positive displacement gear pump for feeding the food product driven by a first servomotor and a rocking cut-off nozzle driven by a second servomotor. The servomotors are capable of making rapid moves with extreme accuracy and repeatability. A computer controls the servomotors via a user-friendly touch screen. Weight control and adjustments are made "on the fly" by the line operator on the touch screen. The three column pump feeds product through three stainless steel tubes which align with the exterior of the three column pump. A plastic cutoff rocks back and forth within the stationary stainless steel housing under the control of a second servomotor to deposit a predetermined precise amount of food product into a series of fast moving trays. The three tubes are attached to a stationary cut-off nozzle housing with corresponding holes. The second servomotor drives this plastic cut-off to open and close the feed to the trays. The computer calculates and deposits the required weight product in the trays. As further advantages, no pneumatics are involved and the apparatus is simple to maintain, clean and operate.

Accordingly, an object of this invention is to provide a new and improved method and a stationary compact apparatus for filling food trays at high speed.

Another object of this invention is to provide a new and improved method and apparatus for filling food trays using computer-controlled servomotors.

A further object of this invention is to provide a new and improved method and apparatus for depositing a predetermined precise amount of food product in trays on a moving conveyor by feeding the product with a computer controlled servo-driven multiple column pump to an outlet nozzle having a computer controlled servomotor opening and closing the nozzle.

A still further object of this invention is to provide a new and improved method and apparatus for filling food trays under control of a computer that calculates the desired weight deposit and adjusts a first and a second servomotor for the required high speed and placement.

A more specific object of this invention is to provide a new and improved method and apparatus for filling food trays moving at high speed on a conveyor which includes a first and second servomotor controlled by a computer with a user friendly touch screen to feed food products to an outlet nozzle and deposit said product in accordance with a computer program for the particular product.

BRIEF DESCRIPTION OF DRAWINGS

The above and other objects of the invention may be more readily seen when viewing in conjunction with the accompanying drawings wherein.

FIG. 2 is an exploded front view of the nozzle and associated parts; and.

DETAILED DESCRIPTION

Figure 1:
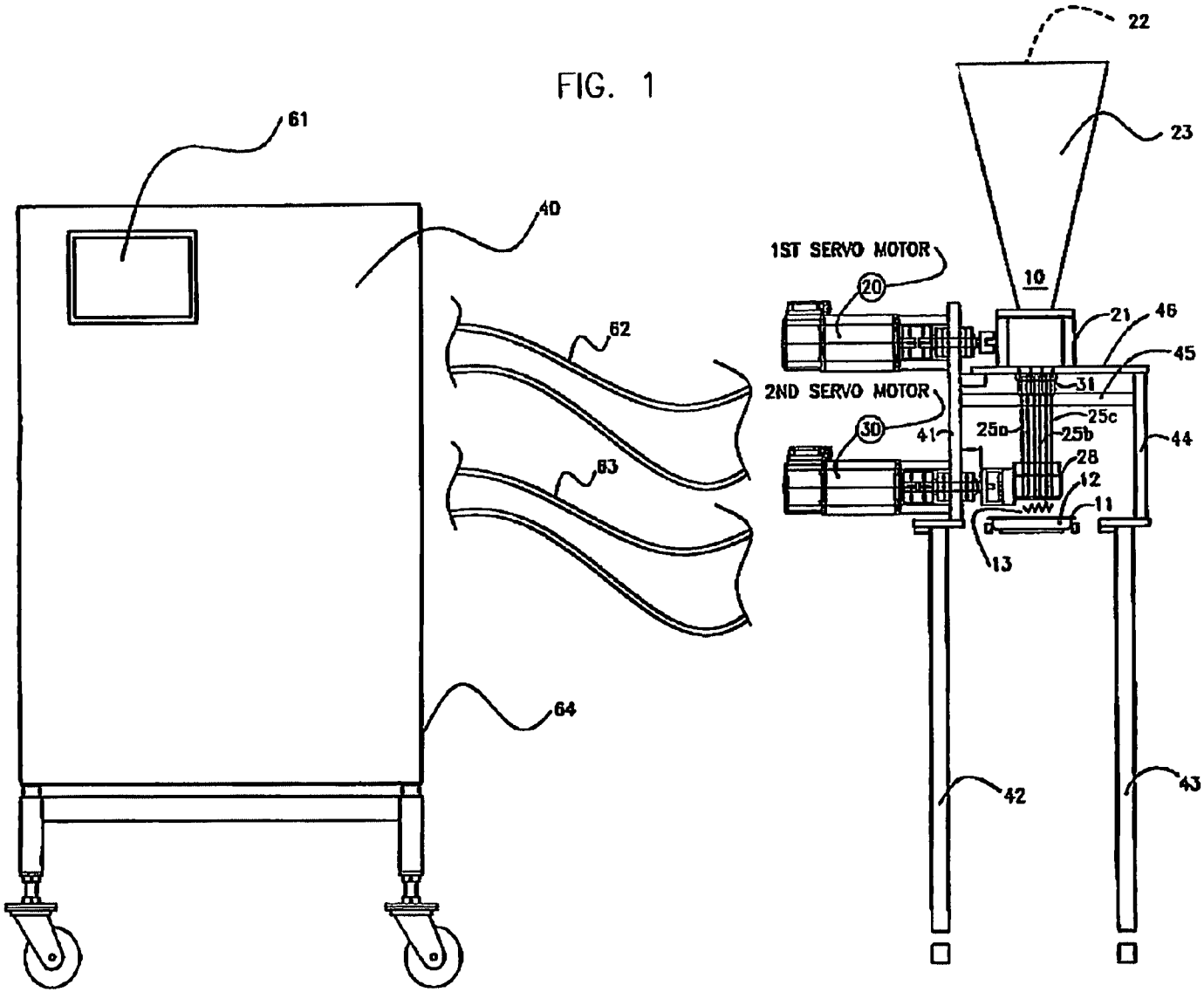
FIG. 1 is a front view of the invention.

Referring now to the drawings and particularly FIG. 1, the invention comprises an apparatus 10 for filling food trays 11 at high speed. The trays 11 each contain a pocket 12 into which a deposit 13 is made at a speed ranging from 1 to 150 trays per minute with a typical speed being 125 trays per minute. The filling deposits 13 can be as low as 1 grams and as high as necessary.

The apparatus 10 includes a first servomotor 20 connected to a three column positive displacement gear pump 21. The servomotor 20 is capable of making rapid moves with extreme accuracy and repeatability. Food product or sauces 22 are deposited into a hopper 23 and fed by pump 21 through a manifold 31 located under the pump 21 which includes three stainless steel tubes 25*a–c* which align with the bottom of the three column pump 21.

The three tubes 25*a–c* are attached to a cut-off nozzle housing 28 with corresponding holes. The cut-off nozzle 49 remains stationary while a plastic insert 32 with the same hole pattern rocks back and forth to create an open and closed pattern under control of the second servomotor 30.

The servomotors 20 and 30 are mounted to a bracket 41 on support leg 42. A spaced second corresponding support leg 43 includes a vertical bracket 44 with cross members 45 and 46 which support the pump 21 and cut-off housing 28 above the feed line which moves between legs 42 and 43 to be fed by the rocking cut-off valve 39. A computer 40 with a user-friendly touch screen 61 is coupled to the servomotors 20 and 30 with respective wires 62, 63 and is mounted on a moveable cart 64.

Figure 2:
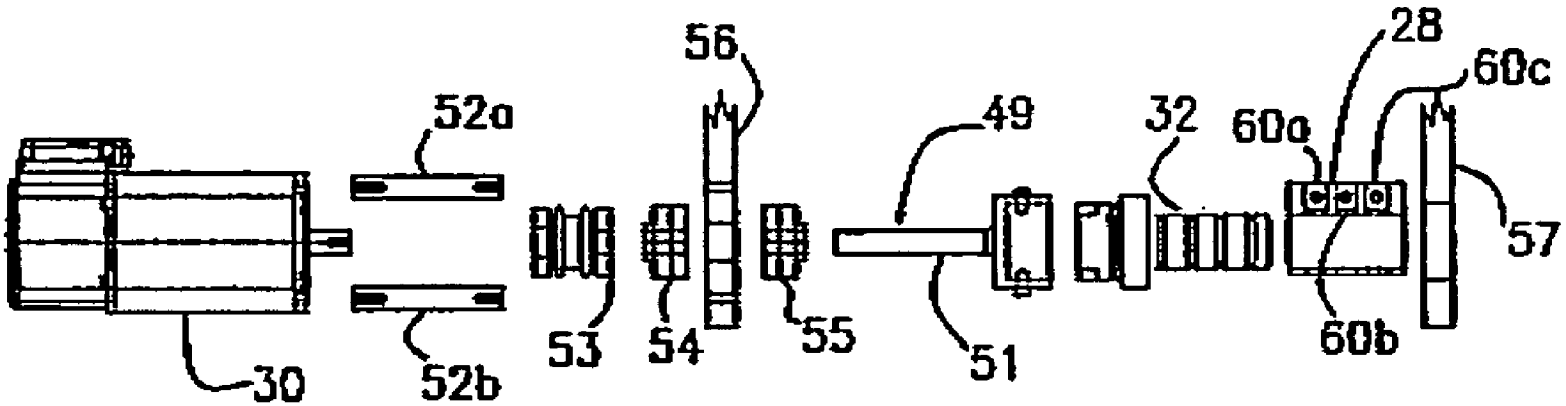

As shown in FIG. 2, the servomotor 30 is coupled to the drive shaft 51 with the rotating cut-off nozzle 49. The rocking cut-off valve 39 is mounted to the nozzle 49 at one end and extends within a stationary cut-off housing 28 with three apertures 60*a–c* on the surface thereof. The plastic rocking valve 39 has the same hole pattern as the housing 28 in order to deposit filling by rocking back and forth under the control of the servomotor 30. The exploded view in FIG. 2 also shows mounting posts 52*a,* 52*b,* and flexible coupling 53 and bearings 54, 55 which mount the shaft 51 to the coupling 53 through the side frame 56. The cut-off housing 28 is mounted to a side frame 57.

Figure 3A:
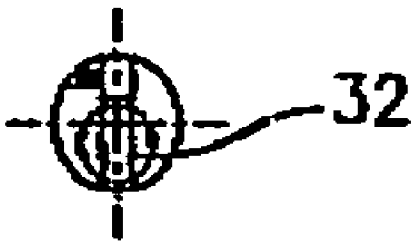
FIG. 3*a* shows the nozzle in an open position and FIG. 3*b* in a closed position.
Figure 3B:
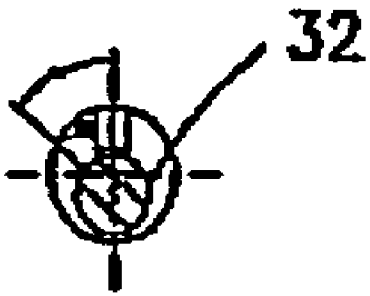

In operation, the second servomotor 30 moves from 0° to 50° back to 0° (see FIG. 3). The degrees of rocking movement depend upon the size of the nozzle and the viscosity of the product and can range up 60°. This represents full open and closed. When a sensing device reads the tray, the servomotor 30 will rotate the valve 32 open leaving it open for the target. The servomotor 30 when rotating the valve open leaves it open for the target length at the bottom of the tray. When the pump 21 completes its forward degree movement, for the required product weight, the pump will make a reverse move of approximately 10 to 20 degrees for suck back or greater if required. The servomotor 20 will then close the cut-off valve.

A computer 40 with a user-friendly touch screen 61 controls both servomotors 20 and 30. The computer calculates the required weight deposit along with the speed and placement of the product 13.

While the invention has been explained by a detailed description of certain specific embodiments, it is understood that various modifications and substitutions can be made in any of them within the scope of the appended claims, which are intended also to include equivalents of such embodiments.

What is claimed is:

1. An apparatus for filling trays moving on a conveyor with a food product comprising:

a first servomotor and a second servomotor;

a computer coupled to the first and second servomotors to operate said servomotors in accordance with computer instructions;

a food source and a pump having a multiple column output connected to the first servomotor and the food source for forcing food product through the multiple column output;

a stationary housing connected to the multiple column pump output and having corresponding multiple outlet apertures;

a cut-off nozzle connected to the second servomotor and including a rocking cut-off valve extending within the housing, said valve including a plurality of apertures which cooperates with the outlet apertures in the housing to deposit predetermined amounts of food product in the moving trays.

2. An apparatus for filling trays in accordance with claim 1 wherein:

the multiple column output comprises three tubes and the stationary housing includes three outlet apertures corresponding to the three tubes.

3. An apparatus for filling trays in accordance with claim 1 wherein:

the second servomotor moves the nozzles from 0 to 50 degrees representing full open on the cut-off valve back to 0 degrees representing full closed on the cut-off valve when a tray appears, said servomotor maintaining the valve in an open position for the target length of the tray.

4. An apparatus for filling trays in accordance with claim 3 wherein:

the pump provides a forward degree movement for the required tray weight and then makes a reverse move of approximately 10 to 20 degrees for suck back, the servomotor then closing the cut-off valve.

5. An apparatus for filling trays in accordance with claim 1 wherein:

the pump is a positive displacement gear pump;

the food source is a hopper having an outlet connected to the pump input;

the computer calculates and provides the required weight deposit along with the speed and placement of the deposit on the tray;

the computer is portably mounted adjacent the servomotors;

a sensor to determine when a tray is not present on the belt and signal the computer not to deposit food product through the cut-off nozzle;

each tray includes a pocket within which the food product is deposited, said nozzle being adjustable to deposit the food product in the center of the tray to fill the tray to its maximum or on the side of tray if a partial fill is require;

a tray can be filled with food product ranging upwardly from 1 grams; and the number of trays filled ranges from 1 to 150 per minute.

6. The method of filling trays comprising the steps of:

moving trays along a conveyor at high speed;

driving a filling pump with a first servomotor;

pumping the food product through a plurality of outlet tubes to a stationary housing;

driving a rocking cut-off valve within the housing with a second servomotor to deposit a predetermined amount of food product in a tray.

7. The method of filling trays in accordance with claim 6 further including the step of:

controlling the first and second servomotors with a computer.

8. The method of filling trays in accordance with claim 6 wherein:

the cut-off valve rocks from 0 degrees (closed) to approximately 60 degrees (open).

9. An apparatus for filling trays in accordance with claim 1, wherein:

the amount of rocking movement depends upon the size of the cut-off valve and the viscosity of the product.

* * * * *